US006532724B2

(12) United States Patent
Patrick

(10) Patent No.: US 6,532,724 B2
(45) Date of Patent: Mar. 18, 2003

(54) CUT-RESISTANT YARN AND METHOD OF MANUFACTURE

(76) Inventor: Gilbert Patrick, 635 Dixon School Rd., Kings Mountain, NC (US) 28086

( * ) Notice: Subject to any disclaimer, the term of this patent is extended or adjusted under 35 U.S.C. 154(b) by 0 days.

(21) Appl. No.: 09/854,661

(22) Filed: May 14, 2001

(65) Prior Publication Data

US 2002/0011062 A1 Jan. 31, 2002

Related U.S. Application Data

(60) Provisional application No. 60/204,314, filed on May 15, 2000.

(51) Int. Cl.[7] ..... D02G 3/18

(52) U.S. Cl. ..... 57/229; 57/249

(58) Field of Search ..... 57/210, 211, 229, 57/230, 231, 236, 237, 238, 239, 240, 243, 249; 64/472; 451/41

(56) References Cited

U.S. PATENT DOCUMENTS

| | | | | |
|---|---|---|---|---|
| 2,783,609 A | | 3/1957 | Breen | 57/140 |
| 3,729,920 A | * | 5/1973 | Sayers et al. | 57/144 |
| 4,304,811 A | | 12/1981 | David et al. | 428/225 |
| 4,381,639 A | | 5/1983 | Kress | 57/229 |
| 4,384,449 A | | 5/1983 | Byrnes, Sr. et al. | 57/210 |
| 4,936,085 A | | 6/1990 | Kolmes et al. | 57/224 |
| 4,967,548 A | | 11/1990 | Fangeat et al. | 57/229 |
| 5,035,111 A | | 7/1991 | Hogenboom et al. | 57/224 |
| 5,070,540 A | | 12/1991 | Behoher et al. | 2/2.5 |
| 5,119,512 A | | 6/1992 | Bunbar et al. | 2/167 |
| 5,177,948 A | | 1/1993 | Kolmes | 57/229 |
| 5,442,815 A | | 8/1995 | Cordova et al. | 2/161 |
| 5,568,657 A | | 10/1996 | Cordova et al. | 2/167 |
| 5,579,628 A | | 12/1996 | Dunbar et al. | 57/246 |
| 5,644,907 A | | 7/1997 | Kolmes et al. | 57/230 |
| 5,721,179 A | | 2/1998 | Kolmes et al. | 442/203 |
| 5,845,476 A | * | 12/1998 | Kolmes | 57/229 |
| 5,853,885 A | | 12/1998 | Prickett | 428/401 |

FOREIGN PATENT DOCUMENTS

| | | | |
|---|---|---|---|
| EP | 0445 872 B1 | 12/1996 | D02G/3/12 |
| WO | WO 97/25464 | 7/1997 | 3/4 |

OTHER PUBLICATIONS

"Standard Test Method for Measuring Cut Resistance of Material Used in Protective Clothing", *American Society for Testing and Materials*, F1790–97, pp. 1–6.

Olson, et al., "Investigation of Fabric Cut Resistance", Final Report of Phase I for Allied–Signal Technologies, Georgia Institute of Technology, Dec. 1989.

"Spectra High Performance Fibers for Protective Clothing," Allied Fibers, not dated.

"Spectra Fibers", http://polymers.alliedsignal.com/performance_fibers/products/spectra.html.

* cited by examiner

*Primary Examiner*—John J. Calvert
*Assistant Examiner*—Shaun R Hurley
(74) *Attorney, Agent, or Firm*—Womble Carlyle Sandridge & Rice, PLLC

(57) ABSTRACT

A yarn is provided which includes a core formed of a glass material and a wrapping yarn wound about the core. The core has a roughened surface, which tends to engage and hold the wrapping yarn. The yarn may exhibit excellent strength, cut resistance and heat resistance, while providing a smooth finish. A method of making the yarn includes roughening the surface of the glass filament by various means.

15 Claims, 1 Drawing Sheet

CUT-RESISTANT YARN AND METHOD OF MANUFACTURE

The present application claims priority to provisional application No. 60/204,314, filed May 15, 2000.

FIELD OF THE INVENTION

The present invention relates to fabrics, yarns and processes for making yarns. In particular, the present invention relates to yarns having an internal core of a glass material encased in an outer fiber, and a process of spinning fibers about a glass material core to form yarns having enhanced strength and cut resistance.

BACKGROUND OF THE INVENTION

It has been known in the textile field to blend or process para-aramid fibers or filaments with other fibers to produce yarns of cut fibers that have enhanced strength and cut and heat resistant properties, for use in forming fabrics or materials for forming protective garments such as cut resistant gloves, etc. Typically, such fibers are spun into yarns using open-end, ring or friction spinning machines that spin the fibers together to form a yarn, or through the use of an industry standard ring twister or a two-for-one twister, wherein each filament is wrapped around each other to produce a single strand of yarn, with each strand being at least partially exposed to the exterior of the total strand. It is further known in the textile field that glass or fiberglass filaments or fibers provide enhanced cut resistance and strength and, therefore, it has been known to use such fibers in conjunction with para-aramid or other fibers to form enhanced cut and heat resistant yarns.

Glass and fiberglass filaments are inherently very hard and smooth, but tend to be very brittle. This brittleness makes it difficult and somewhat impractical to knit yarns of cotton and/or para-aramid fibers with glass or fiberglass filaments, unless some type of protective sheath yarns is twisted or cabled about the fiberglass/glass filaments. For example, U.S. Pat. No. 5,845,476 describes a process of cable twisting filaments wherein different filaments or yarns are wrapped around a core bundle of fiberglass fibers with the outer wrap thus serving as a cover or protective sheath for protecting an inner fiberglass core. This cover protects the fiberglass core from breaking easily during a knitting process and produces a relatively stable yarn, since the fiberglass core is generally substantially covered.

The problem with cable twisting sheath yarns about an inner fiberglass or glass core is that, typically, this process is somewhat slower than conventional yarn spinning processes and is fairly expensive, since the outer yarns must be very tightly wound about the core yarns in order to substantially cover and protect the core yarns from exposure. However, while more conventional yarn spinning processes generally are cheaper and easier, the inherent smoothness of fiberglass and glass filaments tends to allow para-aramid and other fibers to slide or slip off of the smooth, slick core glass filaments. If the mass ratio of the wrapper or sheath fibers to the mass of the core fibers is too low to insure the proper covering of the core, the core will tend to show through the finished yarn and the outer-wrap will tend to slide easily on the core. As a result, slippage occurs during which the wrap or sheath yarns slide and bunch along the filament, thereby exposing the entire core yarn and leading to yarn breakage or weaving machine failure due to resistance of the bunched fibers.

Further, during knitting processes, the core yarns may become exposed to knitting needles that can bend and slide the yarn at excess angles, and thus can engage the glass or fiberglass filaments and cause the breaking thereof. As a result, when such glass core yarns are used in making fabrics for woven clothing, the fabrics typically have broken ends of glass fiber protruding through the outer wrapping or sheath fibers. Such protruding broken fibers can irritate the skin of a wearer and leave the fabric with a rough, unsightly finish and appearance.

Proposed solutions to this problem include processes such as disclosed in U.S. Pat. No. 4,384,449, which discloses the assembling or forming of a yarn having a core made from an inorganic glass with aramid fibers or filaments wound thereabout in counter-directional helixes, such as shown in FIG. 1. This winding addresses the problems of sheath slippage in knitting by providing a cable twisting type process. However, this process uses filaments or pre-formed spun yarns, and, because cabling processes are generally slow, the cost of such yarns typically is fairly high. Similarly, U.S. Pat. No. 5,035,111, proposes minimizing slippage of a sheath yarn from about a core by introducing a yarn with a higher coefficient of friction, to be used as part of the core yarn, along side or in parallel with a yarn having a lower coefficient of friction. Such a dual filament core ultimately increases the cost of the finished yarn product, and in many cases, creates a yarn of a larger size than is needed or desired. In addition, exposure and breaking or splintering of the lower coefficient of friction inorganic filaments can still occur. As stated, such splintering or breaking of the glass fibers tends to result in the glass fibers protruding through the outer sheath yarns and contacting the skin of a person wearing the fabric made from such yarns, thereby causing unacceptable irritation to the wearer and providing a less than finished appearance to the fabric.

It therefore can be seen that the need exists for a process of forming a yarn having a glass or fiberglass core to impart enhanced properties to the yarn, while both allowing for the yarn to be made inexpensively and minimizing the chance of splintering or breaking of the glass core during subsequent knitting and/or weaving operations.

SUMMARY OF THE INVENTION

The present invention includes, among other aspects, a yarn having a roughened core and methods of making such yarns. A yarn is provided having a core formed of a glass material, wherein at least a portion of a surface of the core is roughened. The core may be a glass filament or a filament including a glass material. A fiber is applied to the core. The fiber may be in the form of a wrapping yarn wound about the core. The fiber or wrapping yarn may substantially cover the core, in order to prevent exposure of the core and possible damage thereto. The fiber may include at least one polymer selected from aramids, para-aramids, polyesters, polypropylenes, nylons, cellulosics and co-polymers and blends thereof, as well as other polymers and materials. A yarn having such a core and fiber combination may display, along with other properties, excellent cut resistance, strength and heat resistance. Fabrics, garments and other articles formed of such yarn may also display such properties and are other aspects of the instant invention.

A method of making a yarn with such a roughened core generally will include roughening a surface of the glass-containing core and applying a fiber thereto. The fiber applied thereto may be in the form of a wrapping yarn wound about the core. This wound wrapping yarn may substantially cover the core. The method of making the yarn may include mechanical and/or chemical roughening of the glass core. Mechanical roughening of the core may include contacting a glass, fiberglass or similar high strength, cut resistant fiber or filament, intended to form the core, with a roughening mechanism or assembly. Such a roughening assembly could include, for example, a series of one or more rollers having glass filaments wound thereabout or guide tubes or similar mechanisms having an abrasive material applied over their surfaces and about which the core glass filament is passed.

These and other features, objects, and advantages of the present invention will become more apparent upon review of the detailed description set forth below when taken in conjunction with the accompanying drawing figures, which are briefly described as follows.

DISCUSSION OF THE INVENTION

Figure 2:
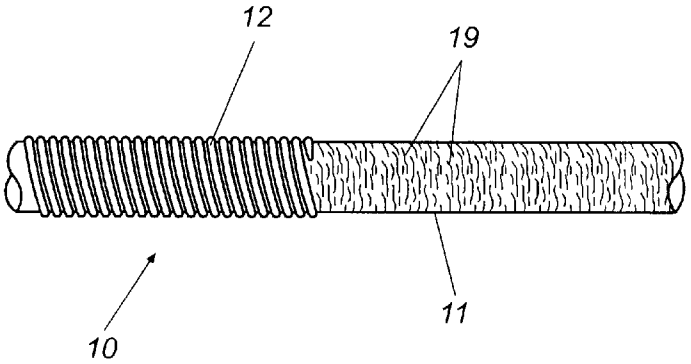
FIG. 2 is a side view of a section of a partially formed yarn that embodies the principles of the present invention.

In general, the present invention is directed to the economical formation of a spun yarn 10, as shown in FIG. 2, with enhanced cut resistance and strength, having a core 11 formed from a glass or fiberglass filament material, about which is wound or spun an outer wrapping material 12. The outer wrapping 12 may be formed from one or more fibers including natural or synthetic polymers such as, for example, para-aramids, aramids, polyesters, polypropylenes, nylons, cellulosics and co-polymers and blends thereof. The cellulosic polymers may include, among others, rayon, cotton and wool. Examples of the synthetic polymeric fibers include Kevlar® and Nomex®. A particular outer wrapping or sheath fiber or filament generally can be selected based upon desired cut and/or heat resistancy characteristics desired for the finished knitted or woven fabric product. In general, the cut-resistant yarn 10 is designed to be produced using a conventional "Dref" type spinning frame and spinning process without requiring additional manufacturing steps or requiring the tight wrapping or cable twisting of sheath yarns about the glass or fiberglass filament core. The finished yarn is thus enabled to endure the mechanical and physical abuses of a knitting machine without physical damage occurring as the yarn is being knitted or woven into a fabric. The resultant yarns typically will be woven or knitted into fabrics having greatly enhanced strength and cut resistance. These fabrics can then be used in forming protective garments such as protective gloves, outer wear such as firefighters' coats, or a variety of other type of garments and articles for which a high cut resistance and enhanced strength, and possibly other properties such as enhanced heat resistance, are necessary or desired.

In general, as shown in FIG. 2, the yarn 10 includes an inorganic glass or fiberglass filament core 11, having a mass ratio of approximately 5% to 55% or more to the sheath or other wrapping yarn 12. Generally, the wrapping yarn 12 will be formed from a virgin and/or recycled para-aramid fiber, or a blend thereof, including para-aramid fibers such as Kevlar® and aramid fibers such as Nomex®, and also can include virgin or natural fibers such as cotton of wool, and synthetic fibers such as polyester, nylon, rayon, acrylic, or blends thereof Generally, the total weight characterized in yarn count for the finished yarn will be between 60–300 Tex. The fiberglass or glass filaments or strands may vary between 650 denier and 98 denier twisted or untwisted.

In forming a yarn of the present invention, the glass or fiberglass filament 11 initially will be roughened slightly so as to cause the surface of these fibers to have higher coefficient(s) of friction, static and/or kinetic. The roughening of the fibers, however, is limited so as to minimize breakage or splintering of the fibers, which can cause a significant loss of integrity or tensile strength of the core filament. The surface of the glass core filament may be roughened by mechanical and/or chemical means. Mechanical abrasion of the core filament may include contacting the filament with a roughening mechanism, such as, for example, a stream of sand or similar abrasive particles, such as in sand blasting, and/or an abrasive medium, such as steel wool, sand paper, glass wool and the like. Chemical abrasion of the core may be accomplished by exposing the core to a chemical agent, such as hydrofluoric acid, which reacts with and mars the surface of the core, thereby increasing the coefficient of friction thereof. Such a chemical agent can be applied by spraying the agent over the filament or fibers, or by passing the core filament through a chemical bath, or other application techniques as will be understood by those skilled in the art.

Figure 3:
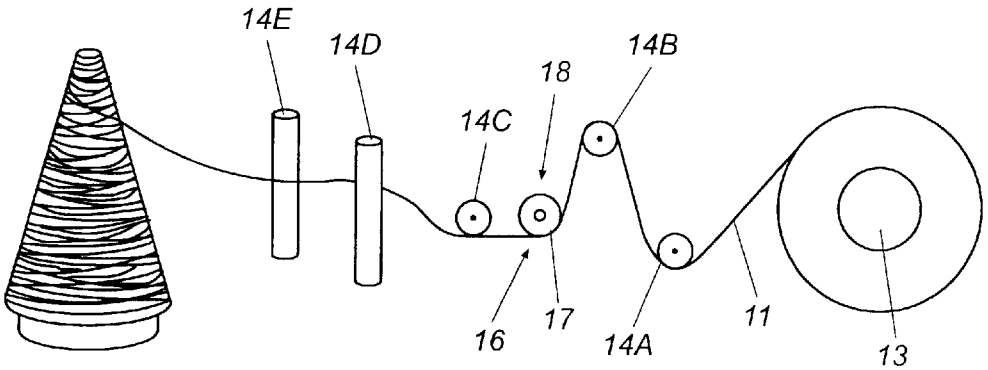
FIG. 3 is a side view of an assembly for roughening a glass filament that embodies the principles of the present invention.
Figure 1:
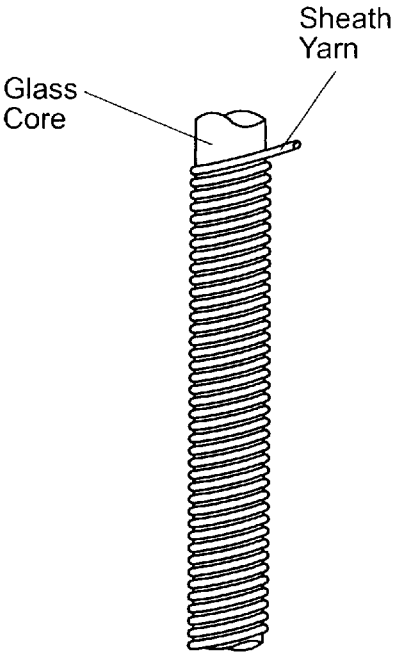
(PRIOR ART) Fig. 1
FIG. 1 is a side view of a section of a partially formed yarn of the prior art.

As shown in FIG. 3, one example embodiment of roughening of the glass core filament includes transferring the core filament from the pin or bobbin roll 13 upon which it is shipped, to the spinning zone of a spinning frame, with the glass/fiberglass filament passing through a series of guides 14A–E as it is transferred. The spinning frame may be a Dref-2, Dref-3, Dref 2000 or similar type spinning frame. Each of the guides generally will comprise a roller or bar typically made from or coated with a ceramic material to protect the guides and to prevent damage to the glass/fiberglass filament as it is passed over and around the guides. The number and spacing of the guides can be varied as desired in order to adjust the tension and to control the feed of the glass/fiberglass filament.

As indicated in FIG. 3, a roughening mechanism or assembly 16, here illustrated as a roller 17, generally is mounted between the guides along the path of travel of the glass/fiberglass filament 11 from its pin or bobbin 13 to the spinning frame. Generally, the mechanism such as the roughening roller 17 is positioned so that the glass/fiberglass filament passes thereabout at approximately a 90° angle, although other angles may be employed and are contemplated. The roughening roller(s) typically is wrapped or covered with an abrasive media, such as a 650 denier or coarser glass filament or strand, indicated by 18, so that the fiberglass/glass filament core 11 has to pass over this layered glass 18 and generally is rotated by the friction between the glass/fiberglass filament core sliding over the layered glass of the roughening roller. The friction of glass sliding over glass further causes the filaments to pick at each other so as to cause a roughening of their surfaces, but not to the extent of breaking or splintering the unwinding glass/fiberglass filament. Other types of roughening elements or mechanisms also can be used in place of or in conjunction with the roller 17 for roughening the surface of the glass/fiberglass filament without breaking or splintering. For example, multiple rollers may be positioned along the path of the glass filament in order to contact and roughen substantially all of the surface thereof. Alternatively, other roughening mechanisms, such as guides, tubes or sleeves having abrasive surfaces so as to scuff or abrade and thus roughen the smooth surface of the core filament.

Depending upon the type of glass and the denier of the glass on the roughening roller(s), if broken fibers are generated as the glass/fiberglass filament core is passed thereover, the amount of roughening being applied to the glass/fiberglass filament core can be varied by decreasing the diameter of the glass-coated roughening roller(s) and/or decreasing the tension of the glass/fiberglass filament being pulled through the guides. Likewise, if the core is not being roughened enough to prevent slippage of the sheath yarns wound thereabout, larger roughening roller(s) wrapped with glass filament can be used and/or greater tension can be placed on the passing filament to increase the amount of roughening being applied to the glass/fiberglass filament core.

The roughened glass/fiberglass filament core may then be introduced into the spinning zone of a Dref-2, Dref-3, or Dref 2000 spinning frame or similar spinning apparatus, wherein wrapping fibers are applied to the glass filament. The wrapping fibers may be synthetic or natural fibers and may be formed individually or as a part of yarns. Some examples of such fibers include cellulosics, such as cotton, wool and rayon; para-aramids such as Kevlar®; aramids such as Nomex®; polyesters, nylons, acrylics and co-polymers and blends of one or more of these fibers. These fibers typically are applied to the glass filament by being wound cylindrically thereabout.

As indicated in FIG. 2, the roughened surface of glass core filament 11, as indicated by roughened or score lines 19, has higher coefficient(s) of friction than would an otherwise identical unroughened glass filament have. This roughened surface, with increased coefficient(s) of friction facilitates the engaging and holding of the applied fibers of a wrapping yarn on the glass/fiberglass core filament and inhibits sliding of the sheath yarn along the core. The resultant yarn is, thereafter, capable of being passed through a knitting machine, without the sheath or wrapping yarn sliding on the core, to create a knitted or woven fabric having enhanced cut resistance, strength, and/or heat resistance. This process is accomplished without requiring additional costs added to the steps and/or without having to incorporate additional yarns with higher coefficients of friction and/or more expensive wrapping processes. An array of articles and fabrics may be formed from this yarn, such articles and fabrics exhibiting such beneficial features as cut and heat resistance. For example, a 6/1CC fiberglass core yarn can be wrapped with Kevlar® for creating a highly cut-resistant yarn for weaving or knitting into fabrics for forming protective products such as knitted, cut-resistant protective gloves, having a soft, finished look and feel at a relatively inexpensive cost.

It will be understood by those skilled in the art that while the present invention has been discussed above with respect to preferred embodiments, various modifications, additions, and changes can be made thereto without departing from the spirit and scope of the invention as set forth in the following claims.

What is claimed is:

1. A yarn comprising:

a core including a glass material, at least a portion of said core having a surface that is abraded so as to provide an increased coefficient of friction; and, a fiber applied to said core.

2. The yarn of claim 1, said core being formed of at least one filament.

3. The yarn of claim 2, said filament being formed of glass.

4. The yarn of claim 1, said fiber being formed of a polymer selected from aramids, para-aramids, acrylics, polyesters, polypropylenes, nylons, cellulosics and co-polymers and blends thereof.

5. The yarn of claim 1, further comprising a wrapping yarn including said fiber, said wrapping yarn being wound about said core.

6. The yarn of claim 5, wherein said wrapping yarn substantially covers said core.

7. The yarn of claim 1, wherein said roughened surface is mechanically abraded.

8. The yarn of claim 1, wherein said roughened surface is chemically abraded.

9. A yarn comprising:

a core formed from at least one glass or fiberglass filament, said core having a surface that is abraded so as to provide an increased coefficient of friction; and, a wrapping yarn wound about said core.

10. The yarn of claim 9, said wrapping yarn being formed of a polymer selected from aramids, para-aramids, acrylics, polyesters, polypropylenes, nylons, cellulosics and co-polymers and blends thereof.

11. The yarn of claim 9, wherein said wrapping yarn substantially covers said core.

12. The yarn of claim 9, wherein said roughened surface is mechanically abraded.

13. The yarn of claim 9, wherein said roughened surface is chemically abraded.

14. A cut-resistant yarn comprising:

a core filament formed of a glass material, at least a portion of said core filament having a mechanically abraded surface; and, a wrapping yarn wound about and substantially covering said core, whereby said roughened surface engages and holds said wrapping yarn about said core.

15. The cut-resistant yarn of claim 14, said wrapping yarn being formed of a polymer selected from aramids, para-aramids, acrylics, polyesters, polypropylenes, nylons, cellulosics, co-polymers and blends thereof.

* * * * *